United States Patent [19]

Buchschmid et al.

[11] Patent Number: 4,951,017

[45] Date of Patent: Aug. 21, 1990

[54] ELECTROMAGNETIC RELAY

[75] Inventors: Emil Buchschmid, Rosstal; Anton Frenznick, Nürnberg; Klaus Lindner, Zirndorf; Olaf Schmid, Schwabach; Hans-Dieter Schmid, Nürnberg; Gerhard Schmidt, Weihenzell; Theodor Sturm, Sachsen, all of Fed. Rep. of Germany

[73] Assignee: Robert Bosch GmbH, Stuttgart, Fed. Rep. of Germany

[21] Appl. No.: 236,355

[22] PCT Filed: Aug. 25, 1987

[86] PCT No.: PCT/DE87/00377

§ 371 Date: Jul. 8, 1988

§ 102(e) Date: Jul. 8, 1988

[87] PCT Pub. No.: WO88/04101

PCT Pub. Date: Jun. 2, 1988

[30] Foreign Application Priority Data

Nov. 28, 1986 [DE] Fed. Rep. of Germany ..... 3640737

[51] Int. Cl.[5] ..... H01H 67/02

[52] U.S. Cl. ..... 335/128; 335/83

[58] Field of Search ..... 335/78–90, 335/106, 115, 128

[56] References Cited

U.S. PATENT DOCUMENTS

| | | | |
|---|---|---|---|
| 3,437,962 | 4/1969 | Bell . | |
| 4,460,881 | 7/1984 | Meister et al. | 335/128 |

FOREIGN PATENT DOCUMENTS

| | | |
|---|---|---|
| 0136592 | 9/1984 | European Pat. Off. . |
| 0144676 | 10/1984 | European Pat. Off. . |
| 735980 | 9/1939 | Fed. Rep. of Germany . |
| 1639296 | 1/1968 | Fed. Rep. of Germany . |
| 1807319 | 11/1968 | Fed. Rep. of Germany . |
| 72239 | 8/1957 | France . |
| 1534341 | 8/1967 | France . |
| 83G1669 | 11/1983 | German Democratic Rep. . |
| 872789 | 7/1961 | United Kingdom . |

*Primary Examiner*—Leo P. Picard
*Assistant Examiner*—Lincoln Donovan
*Attorney, Agent, or Firm*—Michael J. Striker

[57] ABSTRACT

An electromagnetic relay comprising a magnet yoke having a coil core for supporting a relay winding and a support for supporting a folding armature at one end of the folding armature; and a leaf spring for biasing the folding armature away from the coil core in a non-operating position of the relay, the leaf spring including a curl surrounding the support and having two fastening portions at which the leaf spring is fastened to the magnet yoke and the folding armature, respectively, and a prestress area between the two fastening portions.

6 Claims, 2 Drawing Sheets

ELECTROMAGNETIC RELAY

BACKGROUND OF THE INVENTION

The invention relates to an electromagnetic relay with a folding armature.

In such a relay (U.S. Pat. No. 4,260,973, the folding armature of the relay is held by a leaf spring at its support in engagements with the magnet yoke, wherein the leaf spring extend around the support in a form of a curl so as to be close to the support. The leaf spring is prestressed in such a way that it lifts the folding armature from the coil core when the relay winding is switched off and presses the switching contact fastened at the folding armature against a non-operating contact of the relay with a required contact pressure. In so doing, the folding armature is flipped with its support end around a support edge at the magnet yoke.

A disadvantage in this solution is that the contact of the folding armature at the support is only achieved when the center of rotation of the curl coincides with the support edge of the magnet yoke. However, as a result of the tolerances in the leaf spring curl area and the participating components, such as the armature plate and the magnet yoke, the ideal case of a force-free hinge-like contact is achieved, as well as a contact accompanied by pressing and friction, or no contact, i.e. a spacing between the armature plate and the armature bearing, in some cases accompanied by a distinct air gap. But both these cases are undesirable. The contact accompanied by pressing forces leads to a bearing friction, interference in the course of movement or possibly jamming. In the case of an air gap between the armature plate and the support edge, magnetic force is lost because of the increase in the magnetic resistance. This loss is expressed in increased response voltage values. Moreover, shaking and jarring shocks act in their entirety on the leaf spring curl which can be permanently deformed, which can impair the operational reliability of the relay and can lead to outage.

SUMMARY OF THE INVENTION

The object of the present invention is an electromagnetic relay in which a folding armature is pressed to a support at the magnet yoke by a leaf spring with sufficient force to ensure a frictionless and secured against jarring shocks support.

The object of the invention is achieved by providing a relay in which the leaf spring is prestressed in the curl area between fastening points at the folding armature and the magnet yoke in an assembled state, to insure a contact between the folding armature and the magnet yoke at the folding armature support.

The relay according to the invention has the advantage that the force components of the leaf spring, which force components act at the supports in the direction of the fastening points of the leaf spring at the folding armature and at the magnet yoke, prevent a bearing friction caused by axial displacement of the folding armature, on one hand, and a lifting of the folding armature from the magnet yoke during jarring shocks and shaking, on the other hand; the leaf spring is bent around the support in a hairpin shape. Another advantage is to be seen in that, during the production of the leaf spring and during the installation of the folding armature in the relay, the force components are dimensioned in such a way that adjustment tolerances have no influence on the operational reliability of the support.

It is particularly advantageous to bend the leaf spring in the area of the support as a hairpin curl with the arms spread apart at an acute angle with one arm being fastened at its end to the magnet yoke and the other arm, which is fastened to the folding armature, capable of pivoting the folding armature into a non-operating position with a desired restoring force. A lateral tilting or canting of the folding armature is reliably prevented by the arms of the leaf spring being fastened, respectively, to the folding armature and the magnet yoke at two riveting points located adjacent to one another. Preferably, sides, the arms of the leaf spring have two holes into which rivet pins of the folding armature and the magnet yoke project. Relieving of the leaf spring at the riveting points can be avoided by the ends of the arms of the hairpin-shaped curl of the leaf spring being bent in each instance toward the plane of the magnet yoke or of the folding armature before the riveting points. A particularly uniform and therefore careful and reliable support of the folding armature at the magnet yoke is achieved by fastening of the leaf spring at the magnet yoke and at the folding armature whereby the hairpin-shaped curl presses the folding armature to its support at the magnet yoke in such a way that approximately equal force components act on the magnet yoke and on the folding armature in the direction of the fastening or riveting points.

The invention as to its construction so to its mode of operation, together with additional objects and advantages thereof, will be best understood from the following detailed description of the preferred embodiment with reference to the appended drawings.

DESCRIPTION OF THE PREFERRED EMBODIMENT

Figure 1:
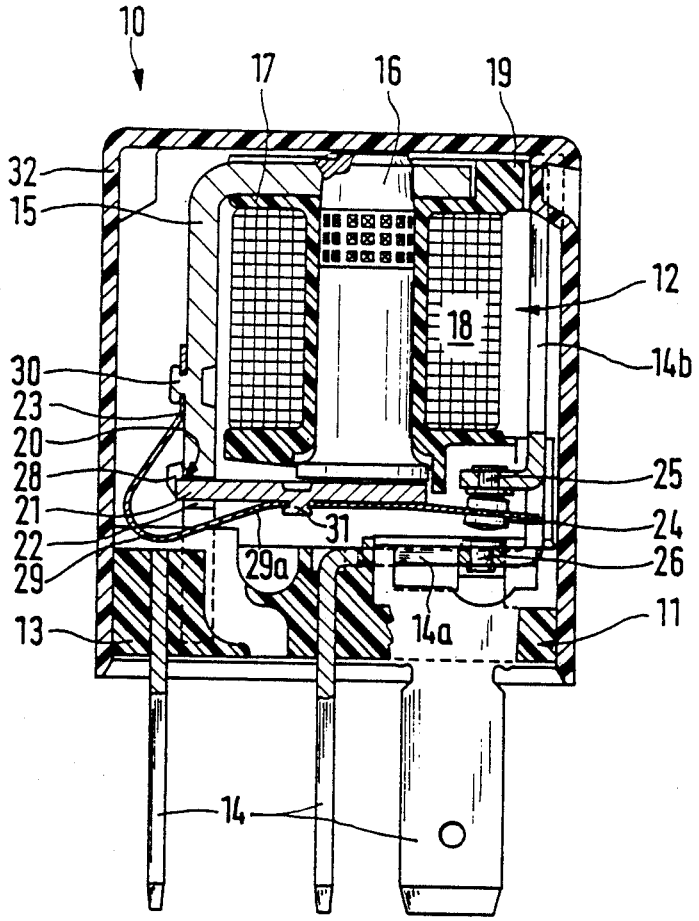
FIG. 1 shows an enlarged longitudinal cross-sectional view a folding armature relay according to the invention.
Figure 2:
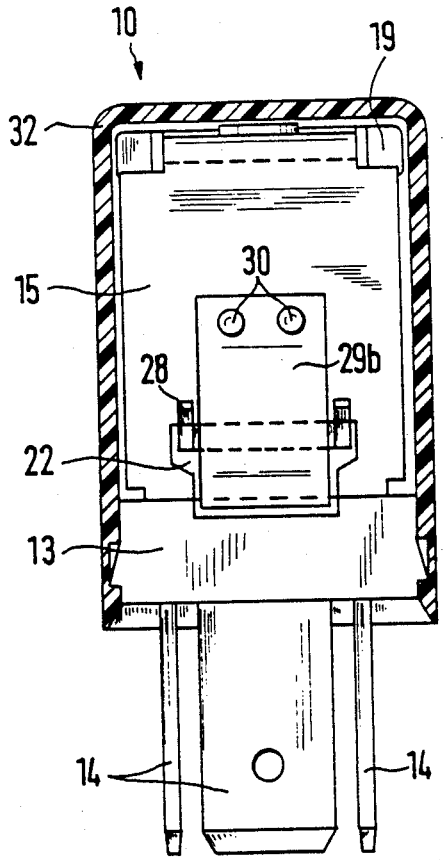
FIG. 2 shows a side view of the same relay.

FIGS. 1 and 2 show an enlarged view of a folding armature relay for motor vehicles which functions as a change-over relay and is designated by 10. It comprises a base group and a magnet system, each of which is separately produced as a preassembled unit and then are assembled together. The base group 11 comprises a base plate 13 of insulating material with connection parts in the form of flat plug-in reeds 14 which are anchored in the base plate 13 and project out at the underside of the base plate 13. Above the base plate, the flat plug-in reeds 14 are provided with bent portions **14*a*, 14*b* for subsequently attaching relay contacts or winding connections. The magnet system 12 comprises an L-shaped magnet yoke 15 with a coil core 16 which is pressed in and fastened at its short side. A coil frame 17, which is produced from insulating material, is placed on the coil core 16 and is in a form-locking and friction-locking connection with the latter provided by a diagonal knurling on the shaft of the coil core 16. A relay winding 18, whose winding ends are in contact in each instance with the end of a connection wire, not shown, which is inserted at the coil frame 17, is located on the coil frame 17. The coil frame 17 is secured against rotation by a shoulder 19 which extends around an outer end portion of the magnet yoke 15. The magnet yoke 15 has a support 20 for a folding armature 21 at the end of its long side, which folding armature 21 is inserted in the area of the support 20 in a recess 22 of the magnet yoke 15 and is held by a leaf spring 23. The leaf spring 23 is both the armature return spring and the contact carrier for a switching contact 24 at the front end of the leaf spring 23. The switching contact 24 cooperates with an operating contact 25 when the folding armature 21 is attracted and with a non-operating contact 26 when the relay is open. In FIG. 1, the relay 10 is shown in the switched on state. In this case, the switching contact 24 contacts the operating contact 25** with the required contact pressure.

Figure 3:
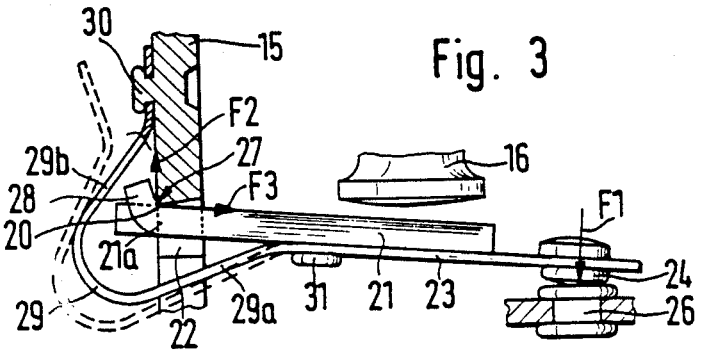
FIG. 3 shows an enlarged partial cross-sectional view of the relay with the folding armature and the magnet yoke in the support area.

FIG. 3 shows the folding armature 21 of the relay with the support 20 at the magnet yoke 15 in the open position, i.e. with switched off relay. The support 20 is constructed as a knife-edge support. At the magnet yoke 15 on the upper side of the recess 22, a support edge 27 extends in the plane of the folding armature 21 and engages a bending edge serving as a step support, two support tabs 28 at the support end 21*a* of the folding armature 21 being bent around the bending edge in a sharp-edged manner in the direction of the magnet yoke 15; the support tabs 28 being located adjacent each other in a spaced relationship. The leaf spring 23 is bent around the support 20 in a hairpin-shaped manner as a curl 29 with the arms 29*a* and 29*b* of the hairpin-shaped curl 29 being spread apart at an acute angle. One arm 29*b* is fastened at the magnet yoke 15 at its end. The other arm, which is fastened at the folding armature 21, presses the switching contact 24 of the folding armature 21 against the non-operating contact 26 with a desired contact pressure F1 in the non-operating position of the folding armature 21.

The original shape of the leaf spring 23 in the area of the curl 29 is shown in a dashed line in FIG. 2. In the mounted state of the folding armature 21, the leaf spring 23 is fastened at the magnet yoke 15 to the end of the arm 29*b* and is accordingly prestressed in such a way that the folding armature 21 contacts the magnet yoke 15 at its support 20 with one of the force components F2 and F3 directed toward the fastening points of the leaf spring 23. In order to ensure an axial alignment of the leaf spring and the armature plate, the arm 29*a* of the leaf spring 23 is connected with the folding armature 21 at two riveting points 31 which are located next to one another. The riveting point 30 at the magnet yoke 15 is likewise formed with one or two extruded rivet pins which are located next to one another.

FIG. 2 shows two riveting points 30 of the leaf spring arm 29*b* at the magnet yoke 15, which riveting points 30 are located next to one another. FIG. 1 shows that the arm 29*a*, 29*b* of the hairpin-shaped curl 29 are provided with holes at the riveting points 30, 31 through which rivet pins of the folding armature 21 and the magnet yoke 15 project. The arms 29*a*, 29*b* of the hairpin-shaped curl 29 are bent toward the plane of the magnet yoke 15 and the folding armature 21 before the riveting points 30 and 31.

By securely riveting the arm 29*b* of the leaf spring 21 at the magnet yoke 15 after the insertion of the folding armature 21 in the recess 22 of the magnet yoke 15, the folding armature 21 is pressed by the curl 29 of the leaf spring 21 on its support 20 at the magnet yoke 15 in such a way that approximately equal force components F2, F3 act at the magnet yoke 15 and at the folding armature 21 in the direction of the riveting points 30 and 31; the curl 29 being bent to a hairpin shape. Magnet system 12 and base group 11 of the relay are enclosed by an insulating housing 32 so as to be splashproof.

While the invention has been illustrated and described with reference to a specific embodiment of an electromagnetic relay, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electromagnetic relay having operating and non-operating positions and comprising contact and connection means; a base plate made of an insulating material for supporting said contact and connection means; a relay winding; a magnet yoke fastened to said base plate and including a coil core for supporting said relay winding; a folding armature which engages with said coil core in the operating position of said electromagnetic relay, said magnet yoke having a support for pivotally supporting said folding armature at an end of said folding armature; and a leaf spring for biasing said folding armature away from said coil core in non-operating position of said electromagnetic relay, said leaf spring including a hairpin-shaped curl surrounding said support and having first and second arms extending at acute angle to each other in the non-operative position of said electromagnetic relay, said first and second arms having, respectively, first and second end portions having first and second fastening locations, respectively, at which said leaf spring is fastened to said magnet yoke and said folding armature, respectively, at locations remote from said support, said hairpin-shaped curl having a prestress area between said first and second fastening locations, said first arm providing a first force component for biasing said folding armature into engagement with said support, and said second arm providing a second force component for pivoting said folding armature to its non-operative position.

2. An electromagnetic relay according to claim 1 wherein said magnet yoke is L-shaped, said relay further comprising a switching contact and at least one other contact cooperating with said switching contact to switch said electromagnetic relay between said operating and non-operating positions, said switching contact being fastened at said second opposite end portion in a spaced relationship with respect to said second fastening location.

3. An electromagnetic relay according to claim 1 wherein said first and second force components are substantially equal.

4. An electromagnetic relay according to claim 3 wherein at least one of said first and second fastening locations comprises two adjacent fastening points.

5. An electromagnetic relay according to claim 4 wherein each of said two adjacent fastening points comprises an opening, a respective one of said magnet yoke and said folding armature comprising two pins projecting through said openings.

6. An electromagnetic relay according to claim 5 wherein each of said first and second arms forms a bend toward a plane of said magnet yoke and said folding armature, respectively, said bend being arranged before respective fastening points.

* * * * *